US006279640B1

(12) United States Patent
Van Lennep

(10) Patent No.: US 6,279,640 B1
(45) Date of Patent: Aug. 28, 2001

(54) AWNING DEVICE

(76) Inventor: John F. Van Lennep, 6888 Skyline Dr., Delray Beach, FL (US) 33446

( * ) Notice: Subject to any disclaimer, the term of this patent is extended or adjusted under 35 U.S.C. 154(b) by 0 days.

(21) Appl. No.: 09/621,990

(22) Filed: Jul. 21, 2000

(51) Int. Cl.[7] ..... E04F 10/10
(52) U.S. Cl. ..... 160/62; 160/32
(58) Field of Search ..... 160/22, 32, 33, 160/34, 35, 36, 37, 61, 77, 45, 62

(56) References Cited

U.S. PATENT DOCUMENTS

| | | | | |
|---|---|---|---|---|
| D. 195,402 | | 6/1963 | Trombley . | |
| 2,187,242 | * | 1/1940 | Kesner | 160/77 X |
| 2,670,792 | * | 3/1954 | Del Rio | 160/61 X |
| 2,672,192 | * | 3/1954 | Goldner | 160/32 |
| 2,682,923 | | 7/1954 | Yuhas . | |
| 2,729,287 | * | 1/1956 | Goldner | 160/33 |
| 3,429,070 | | 2/1969 | Hurst . | |
| 3,516,470 | * | 6/1970 | Kurz | 160/35 |
| 4,068,699 | * | 1/1978 | Tucker | 160/33 |
| 4,171,013 | | 10/1979 | Clark . | |
| 4,457,106 | | 7/1984 | Forquer . | |
| 5,873,202 | | 2/1999 | Parks . | |

* cited by examiner

*Primary Examiner*—David M. Purol

(57) ABSTRACT

A awning device for attachment to mobile homes, recreational vehicles and the like. The awning device includes a frame. The frame comprises a top bar, a pair of side bars and a bottom bar. Each of the side bars defines a guide member. Each of the side bars has a first end is integrally coupled to the top bar. The bottom bar is elongate and extends between and is integrally coupled to the second ends of the side bars such that the frame generally has a rectangular shape. Each of a plurality of slats is removably positioned in the top bar such that each of the slats is slidably movable along the side bars. The slats are selectively positionable between an extended position and a retracted position.

4 Claims, 2 Drawing Sheets

AWNING DEVICE

BACKGROUND OF THE INVENTION

1. Field of the Invention

The present invention relates to awnings and more particularly pertains to a new awning device for attachment to mobile homes, recreational vehicles and the like.

2. Description of the Prior Art

The use of awnings is known in the prior art. More specifically, awnings heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 14,171,013; 5,873,202; 4,457,106; 3,429,070; 2,682,923; and U.S. Des. Pat. No. 195,402.

While these devices fulfill their respective, particular objectives and requirements, the aforementioned patents do not disclose a new awning device. The inventive device includes a frame. The frame comprises a top bar, a pair of side bars and a bottom bar. Each of the side bars defines a guide member. Each of the side bars has a first end is integrally coupled to the top bar. The bottom bar is elongate and extends between and is integrally coupled to the second ends of the side bars such that the frame generally has a rectangular shape. Each of a plurality of slats is removably positioned in the top bar such that each of the slats is slidably movable along the side bars. The slats are selectively positionable between an extended position and a retracted position.

In these respects, the awning device according to the present invention substantially departs from the conventional concepts and designs of the prior art, and in so doing provides an apparatus primarily developed for the purpose of attachment to mobile homes, recreational vehicles and the like.

SUMMARY OF THE INVENTION

In view of the foregoing disadvantages inherent in the known types of awnings now present in the prior art, the present invention provides a new awning device construction wherein the same can be utilized for attachment to mobile homes, recreational vehicles and the like.

The general purpose of the present invention, which will be described subsequently in greater detail, is to provide a new awning device apparatus and method which has many of the advantages of the awnings mentioned heretofore and many novel features that result in a new awning device which is not anticipated, rendered obvious, suggested, or even implied by any of the prior art awnings, either alone or in any combination thereof.

To attain this, the present invention generally comprises a frame. The frame comprises a top bar, a pair of side bars and a bottom bar. Each of the side bars defines a guide member. Each of the side bars has a first end is integrally coupled to the top bar. The bottom bar is elongate and extends between and is integrally coupled to the second ends of the side bars such that the frame generally has a rectangular shape. Each of a plurality of slats is removably positioned in the top bar such that each of the slats is slidably movable along the side bars. The slats are selectively positionable between an extended position and a retracted position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new awning device apparatus and method which has many of the advantages of the awnings mentioned heretofore and many novel features that result in a new awning device which is not anticipated, rendered obvious, suggested, or even implied by any of the prior art awnings, either alone or in any combination thereof.

It is another object of the present invention to provide a new awning device which may be easily and efficiently manufactured and marketed.

It is a further object of the present invention to provide a new awning device which is of a durable and reliable construction.

An even further object of the present invention is to provide a new awning device which is susceptible of a low cost of manufacture with regard to both materials and labor, and which accordingly is then susceptible of low prices of sale to the consuming public, thereby making such awning device economically available to the buying public.

Still yet another object of the present invention is to provide a new awning device which provides in the apparatuses and methods of the prior art some of the advantages thereof, while simultaneously overcoming some of the disadvantages normally associated therewith.

Still another object of the present invention is to provide a new awning device for attachment to mobile homes, recreational vehicles and the like.

Yet another object of the present invention is to provide a new awning device which includes a frame. The frame comprises a top bar, a pair of side bars and a bottom bar. Each of the side bars defines a guide member. Each of the side bars has a first end is integrally coupled to the top bar.

The bottom bar is elongate and extends between and is integrally coupled to the second ends of the side bars such that the frame generally has a rectangular shape. Each of a plurality of slats is removably positioned in the top bar such that each of the slats is slidably movable along the side bars. The slats are selectively positionable between an extended position and a retracted position.

Still yet another object of the present invention is to provide a new awning device that is retrofittable to existing recreational vehicles and mobile homes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
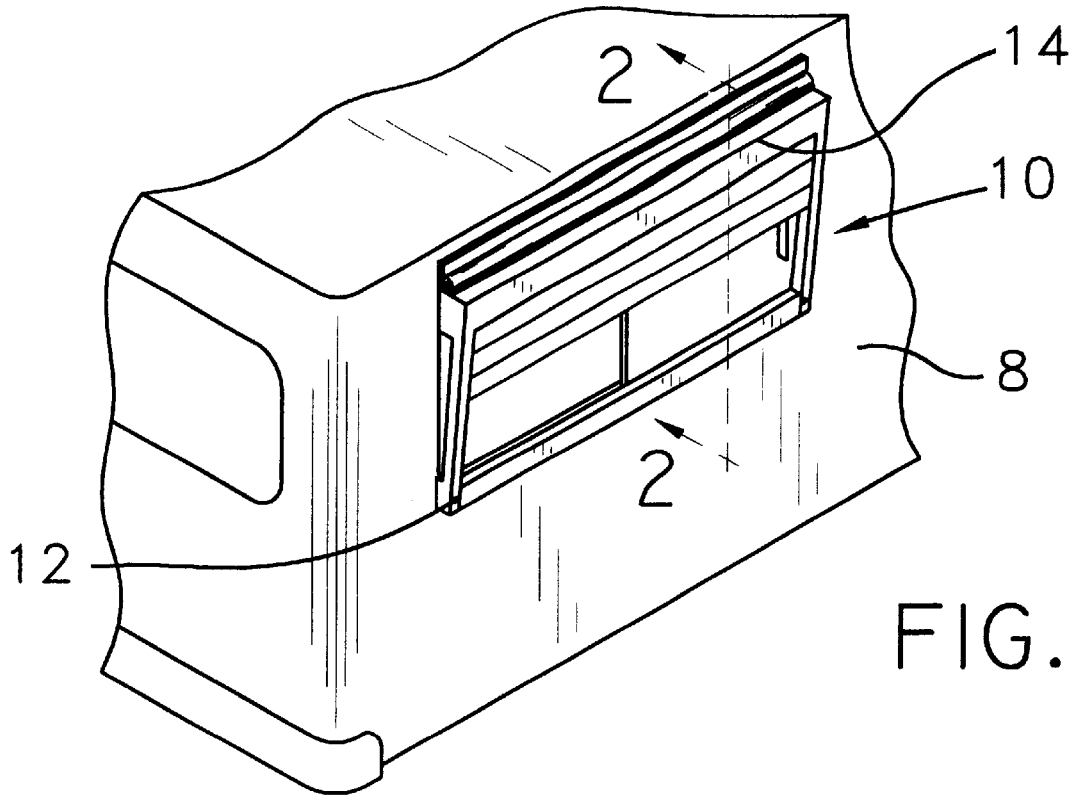
FIG. 1 is a schematic perspective view of a new awning device according to the present invention.

With reference now to the drawings, and in particular to FIGS. 1 through 5 thereof, a new awning device embodying the principles and concepts of the present invention and generally designated by the reference numeral 10 will be described.

As best illustrated in FIGS. 1 through 5, the awning device 10 generally comprises a frame 12. The frame 12 includes a top bar 14. The top bar 14 comprises a housing having a top wall 16, a bottom wall 18, back wall 20, a front wall 22, and a pair of side walls 23. The housing, or top bar 14, has an elongate slot 24 therein. The slot 24 is in the bottom wall 18 and adjacent to the front wall 22. The slot 24 extends between the side walls 23. The top wall 16 is hingedly coupled to an outside wall 8 of a mobile home or recreational vehicle.

A pair of side bars 26 each has a first end 28 and a second end 30. Each of the first ends 28 is integrally coupled to the bottom wall 18 and abuts one of the side walls 23 of the housing 14. The slot 24 in the housing 14 extends into each of the side bars 26 such that each of the side bars 26 defines a guide member. The guide members are generally U-shaped railings.

A bottom bar 32 is elongate and extends between and is integrally coupled to the second ends 30 of the side bars 26. The bottom bar 32 may be coupled by a coupling means to an anchor bar 34 which is securely attached to the outer wall 8 to selectively couple the bottom bar to the outer wall 8. The frame 12 generally has a rectangular shape.

Figure 4:
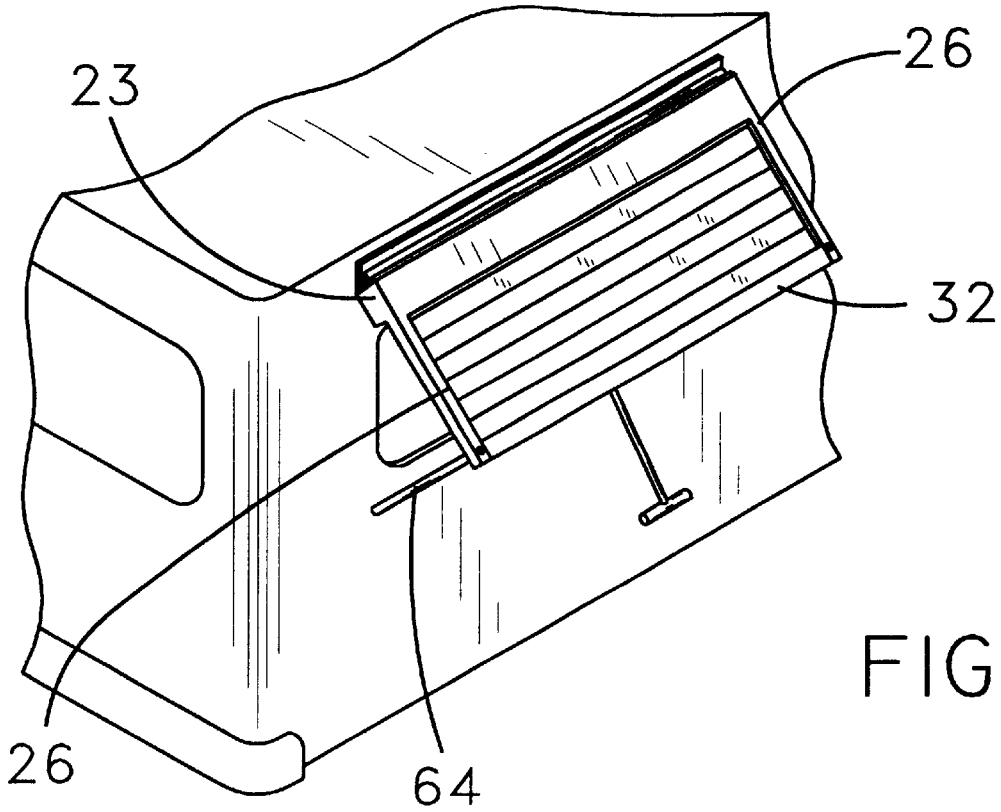
FIG. 4 is a schematic perspective view of the present invention.
Figure 3:
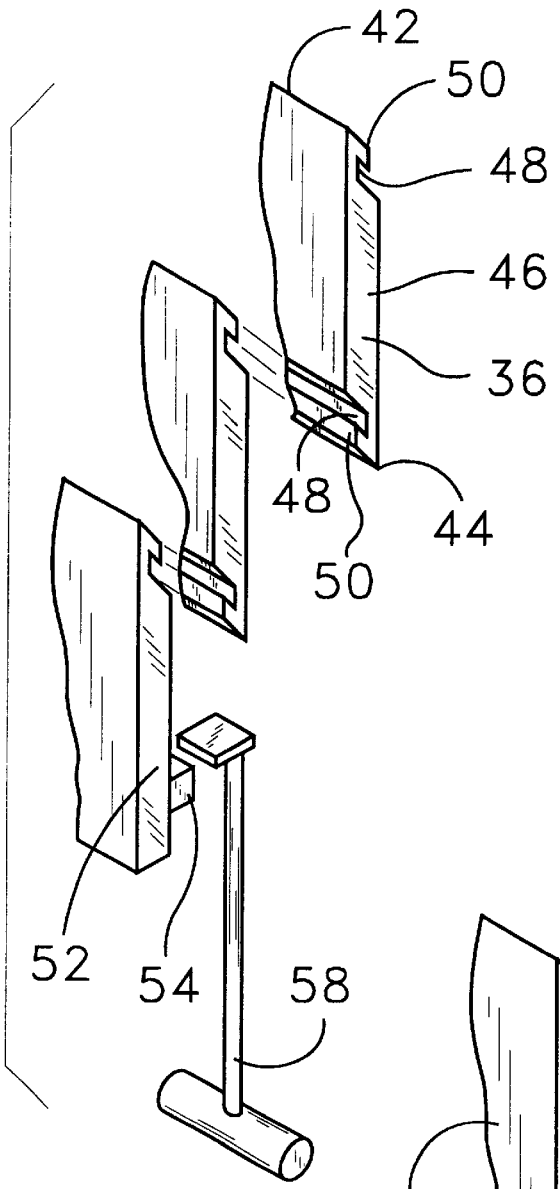
FIG. 3 is a schematic perspective view of the slots of the present invention.
Figure 2:
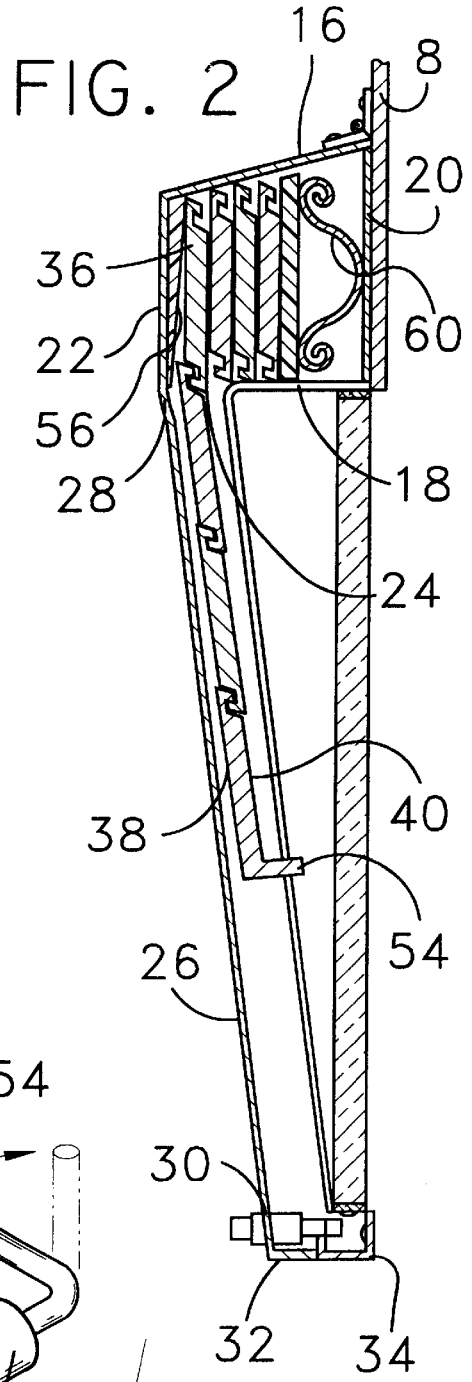
FIG. 2 is a schematic side cross-sectional view taken along line 2—2 of the present invention.
Figure 5:
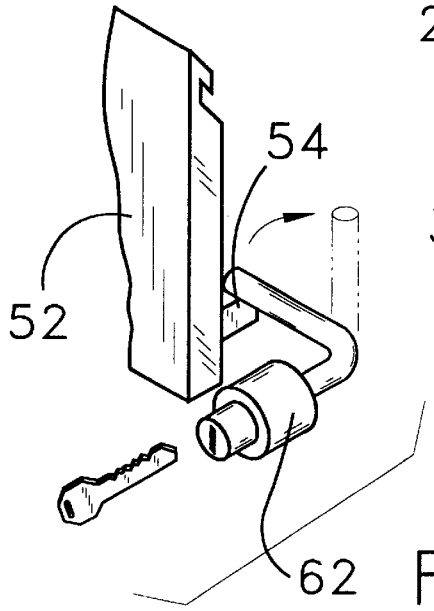
FIG. 5 is a schematic perspective view of the locking means of the present invention.

Each of a plurality of slats 36 is removably positioned in the housing 14. Each of the slats 36 has a front side 38, a back side 40, a top edge 42, a bottom edge 44 and a pair of side edges 46. Each of the front 38 and back 40 sides has an elongate channel 48 therein extending between the side edges 46. Each of the channels 48 in the front sides 38 is positioned nearer the bottom edges 44 and each of the channels 48 in the back sides 40 is positioned nearer the top edges 42. A lip 50 is formed between each of the channels 48 and a relatively adjacent edge 42, 44. A first 52 of the slats is abutted against the front wall 22 of the housing 14 when all of the slats 36 are in the housing 14. The first slat 52 has a handle member 54 thereon positioned on the back side 40 of the first slat 52 and located generally adjacent to the bottom edge 44 of the first slat 52. Each of the slats 36 may extend through the slot 24 in the housing 14 and slidably move along a length of the guide members 26. The slats 36 are selectively positionable between an extended position as shown in FIG. 4 and a retracted position. The lip 50 on the back side 40 of a slat 36 extending through the slot 24 engages the channel 48 in the front side 38 of the next adjacent slat 36 in the housing 12. The channels 48 are in an angular relationship with the slats 36 so that the lips 50 will move out of the channels 48 when the slats 36 are moved upwardly toward the housing 14. The front wall 22 has an inner surface 56 sloped toward the back wall 20 to facilitate the releasing of the lips 50 by the channels 48. A pulling member 58 is used for engaging the handle member 54.

A biasing means 60 biases the slats 36 away from the back wall 20 of the housing 14. The biasing means 60 is positioned between the back wall 20 and the slats 36. Any conventional biasing means may be used.

A locking means 62 locks the slats 36 in the extended position. The locking means 62 is adapted for engaging the handle member 54. The locking means 62 is positioned in the bottom bar 32 and comprises a conventional locking means.

In use, the top bar 14 is coupled to the outside wall 8 of a dwelling or mobile home. When needed, the slats 36 may be placed in an extended position to add privacy. The top bar 14 is hinged to the outer wall so that the device may be pivoted away from the outer wall 8 as shown in FIG. 4. Rods 64, telescoping or otherwise, support the bottom bar 32 away from the outer wall 8. A conventional crank mechanism, not shown, may be positioned within the dwelling and used to push the bottom bar 32 away from the outer wall. The locking means 62 may be used to engage the first slat 52 and hold the slats 32 in the extended position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An awning device, said device being positionable over a window and removably mountable to an outside wall, said device comprising:

a frame, said frame comprising;

a top bar;

a pair of side bars, each of said side bars defining a guide member, each of said side bars having a first end being integrally coupled to said top bar;

a bottom bar, said bottom bar being elongate, said bottom bar extending between and being integrally coupled to a second end of said side bars such that said frame generally has a rectangular shape;

a plurality of slats, each of said slats being removably positioned in said top bar such that each of said slats are movable along said side bars, said slats being selectively positionable between an extended position and a retracted position;

a housing having a top wall, a bottom wall, back wall, a front wall, and a pair of side walls, said housing having an elongate slot therein, said slot being in said bottom wall and adjacent to said front wall, said slot extending between said side walls, said top wall being hingedly coupled to said outside wall, said slot extending into each of said side bars;

wherein each of said slats has a front side, a back side, a top edge, a bottom edge and a pair of side edges, each of said front and back sides having an elongate channel therein extending between said side edges, each of said channels in said front sides being positioned nearer said bottom edges and each of said channels in said back sides being positioned nearer said top edges such that a lip is formed between each of said channels and a relatively adjacent edge, a first of said slats being abutted against said front wall of said housing when all of said slats are in said housing, wherein each of said slats may extend through said slot in said housing and move along a length of said guide members, wherein the lip on the back side of a slat extending through said slot engages the channel in the front side of the next adjacent slat in said housing;

said first slat having a handle member thereon positioned on said back side of said first slat and located generally adjacent to said bottom edge of said first slat;

said handle member extending from a plane of an inner face of said first slat; and a pulling member for engaging said handle member.

2. The awning device as in claim 1, further comprising:

a biasing means for biasing said slats away from said back wall of said housing, said biasing means being positioned between said back wall and said slats.

3. The awning device in claim 1, further comprising a locking means for locking said slats in said extended position, said locking means being adapted for engaging said handle member, said locking means being positioned in said bottom bar.

4. An awning device, said device being positionable over a window and removably mountable to an outside wall, said device comprising:

a frame, said frame comprising;

a top bar, said top comprising a housing having a top wall, a bottom wall, back wall, a front wall, and a pair of side walls, said housing having an elongate slot therein, said slot being in said bottom wall and adjacent to said front wall, said slot extending between said side walls, said top wall being hingedly coupled to said outside wall;

a pair of side bars, each of said side bars having a first end and a second end, each of said first ends being integrally coupled to said bottom wall and abutting one of said side walls of said housing, said slot in said housing extending into each of said side bars such that each of said side bars defines a guide member;

a bottom bar, said bottom bar being elongate, said bottom bar extending between and being integrally coupled to said second ends of said side bars such that said frame generally has a rectangular shape;

a plurality of slats, each of said slats being removably positioned in said housing, each of said slats having a front side, a back side, a top edge, a bottom edge and a pair of side edges, each of said front and back sides having an elongate channel therein extending between said side edges, each of said channels in said front sides being positioned nearer said bottom edges and each of said channels in said back sides being positioned nearer said top edges such that a lip is formed between each of said channels and a relatively adjacent edge, a first of said slats being abutted against said front wall of said housing when all of said slats are in said housing, said first slat having a handle member thereon positioned on said back side of said first slat and located generally adjacent to said bottom edge of said first slat, wherein each of said slats may extend through said slot in said housing and move along a length of said guide members, said slats being selectively positionable between an extended position and a retracted position, wherein the lip on the back side of a slat extending through said slot engages the channel in the front side of the next adjacent slat in said housing, said channels being in an angular relationship with said slats;

a biasing means for biasing said slats away from said back wall of said housing, said biasing means being positioned between said back wall and said slats;

a locking means for locking said slats in said extended position, said locking means being adapted for engaging said handle member, said locking means being positioned in said bottom bar;

said handle member extending from a plane of an inner face of said first slat; and a pulling member for engaging said handle member.

* * * * *